US010470962B1

(12) United States Patent
Filderman

(10) Patent No.: US 10,470,962 B1
(45) Date of Patent: Nov. 12, 2019

(54) APPARATUS FOR REHYDRATING SPINAL DISKS AND RELIEVING SPINAL DISK PAIN

(71) Applicant: Robert Filderman, Monterey, CA (US)

(72) Inventor: Robert Filderman, Monterey, CA (US)

( * ) Notice: Subject to any disclaimer, the term of this patent is extended or adjusted under 35 U.S.C. 154(b) by 0 days.

(21) Appl. No.: 16/510,026

(22) Filed: Jul. 12, 2019

(51) Int. Cl.
*A61H 1/02* (2006.01)

(52) U.S. Cl.
CPC ... *A61H 1/0229* (2013.01); *A61H 2201/0161* (2013.01); *A61H 2201/1638* (2013.01); *A61H 2203/0487* (2013.01)

(58) Field of Classification Search
CPC ..... A61H 1/0229; A61H 2201/0161; A61H 2201/1638; A61H 2203/0487
See application file for complete search history.

(56) References Cited

U.S. PATENT DOCUMENTS 5,922,011 A * 7/1999 Cuccia ..... A61H 1/0229 606/241
6,547,809 B1 * 4/2003 Cuccia ..... A61G 13/009 606/241
2010/0000546 A1 * 1/2010 Park ..... A61H 3/008 128/845
2017/0128310 A1 * 5/2017 Roeder ..... A61H 1/0229

* cited by examiner

*Primary Examiner* — Joshua Lee

(57) ABSTRACT

A spinal disk relief apparatus may include a frame configured to carry a body weight of a patient. The frame has a right side, a left side, and a back side. The right side is at approximately a right angle to the back side while the spinal disk relief apparatus is in an unfolded state. The left side is at approximately a right angle to the back side while the spinal disk relief apparatus is in the unfolded state. The spinal disk relief apparatus may also include a belt configured to provide under arm support to arms of the patient. The belt is mounted to the frame by at least four straps. The back side comprises an adjustable lower bar configured to support shins of the patient. The spinal disk apparatus causes the patient supported by the apparatus to experience a rehydrated spinal disk.

20 Claims, 7 Drawing Sheets

APPARATUS FOR REHYDRATING SPINAL DISKS AND RELIEVING SPINAL DISK PAIN

TECHNICAL FIELD

Implementations of the disclosure relate to spinal disk pain relief, and in particular, to an apparatus for rehydrating spinal disks and relieving spinal disk pain.

BACKGROUND

Spinal disk problems may be caused by a number of factors including severe injuries, lifting heavy objects, slipping and falling, etc. These factors may apply stress on the spinal disks which may cause the disk material to bulge out or rupture, resulting in herniated discs. Herniated spinal disks may cause lower back pain due to pinching of the sciatic nerve by the compressed disks. Rehydrating spinal disks can treat herniated and bulging disks and consequently can relief back pain due to spinal disk problems.

BRIEF DESCRIPTION OF THE DRAWINGS

The accompanying drawings, which are incorporated herein and form a part of the specification, illustrate the disclosure and, together with the description, further serve to explain the principles of the disclosure and to enable a person skilled in the pertinent art to make and use the disclosure. The disclosure is illustrated by way of examples, and not by way of limitation, in the figures of the accompanying drawings.

DETAILED DESCRIPTION

Figure 1:
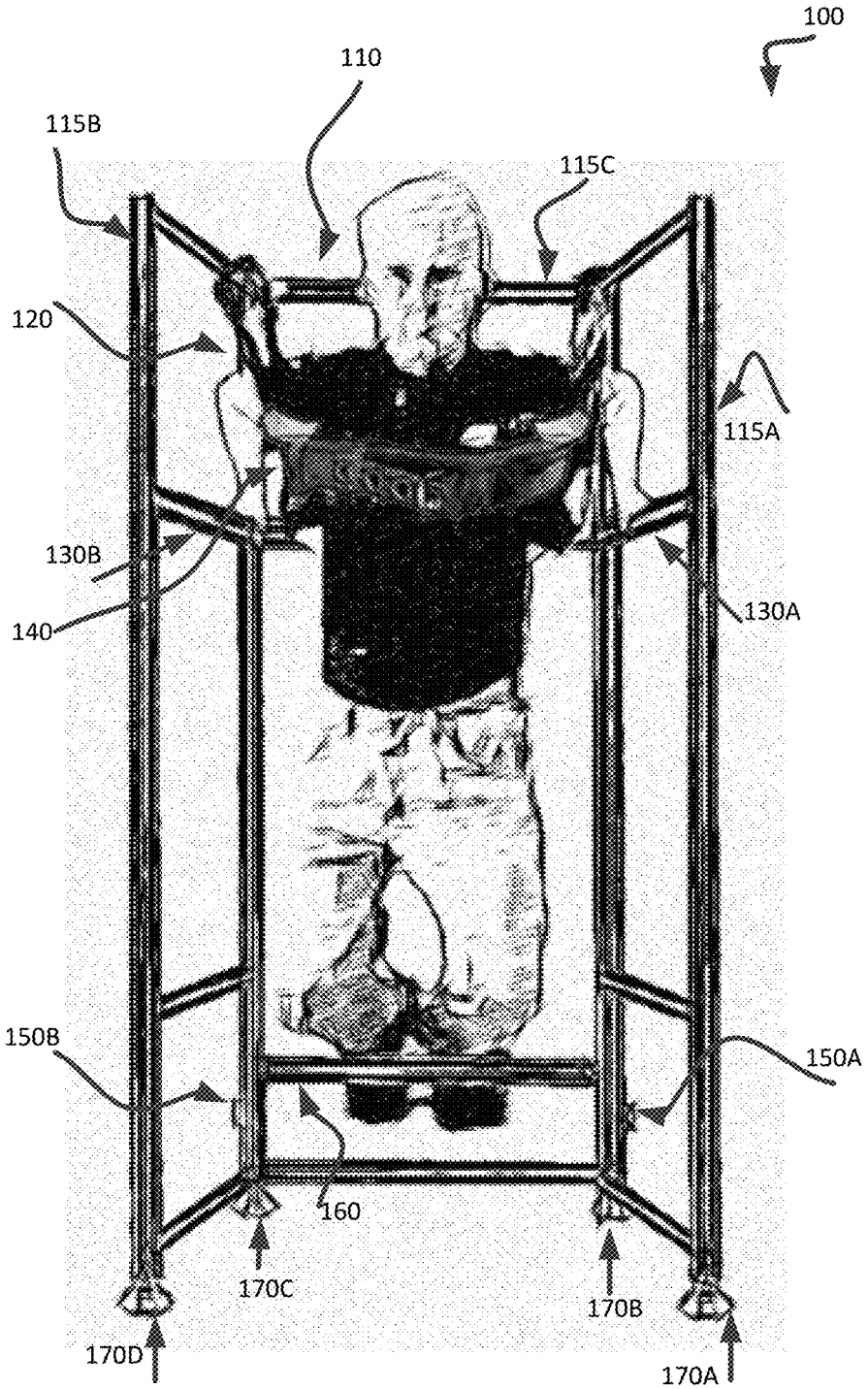
FIG. 1 illustrates an apparatus, in an unfolded state, for rehydrating spinal disks and relieving spinal disk pain of a patient, in accordance with embodiments of the disclosure.

The present disclosure applies to an apparatus for relieving lower back pain and rehydrating spinal disks for patients suffering from lower back pain, due to a herniated spinal disk for example. Several factors may cause herniated spinal disk including repeatedly lifting heavy items, having a substantial body weight, having a consistent poor posture, etc. Such factors may compress the spinal disks of a patient, causing the disk material to bulge out or rupture and eventually resulting in herniated disks and pinching of the sciatic nerve. Moreover, when the patient sits or stands the weight of his or her body presses down on the lower back, causing more stress and pain to the weak or herniated areas of the back. Because the disk material may rupture in a herniated disk, the disk may lose its natural fluids over time, resulting in a flat and weak disk. Rehydrating spinal disks may refer to a process aiming at relieving the stress off herniated disks through cycles of compression and traction movements, thus allowing the spine to replenish the missing fluids back into the disks naturally.

Conventional approaches to spinal disk problems may include stretching the body of the patient using sophisticated machines at a health care facility. For example, a treatment machine may include an inverted table to relief pressure from the patient's back while the patient is stretched upside down on the inverted table. While repeated treatment sessions using this machine may relieve the back pain for a certain period of time, the cost of the sessions is typically high, especially if those sessions are needed for a long period of time until complete recovery is achieved. Such high cost may be prohibitive to many patients seeking back pain relief. Additionally, when the factors causing the back pain are ongoing, it may not be sustainable to use machines at health care facilities for an extended period of time, thus an at-home treatment option may be desired.

Aspects of the present disclosure address the above and other deficiencies by providing an apparatus for rehydrating spinal disks and relieving spinal disk pain of a patient. The apparatus may contain a frame configured to carry a body weight of a patient. The frame may have a right side and a left side of approximately equal width and a back side of greater width than the left side and the right side. The right side may be connected to a first end of the back side by one or more first hinges (e.g., a first pair of hinges), and the left side may be connected to a second end of the back side by one or more second hinges (e.g., a second pair of hinges). The right side may be positioned at approximately a right angle to the back side while the spinal disk relief apparatus is in an unfolded state, and the left side may be positioned at approximately a right angle to the back side while the spinal disk relief apparatus is in the unfolded state.

The apparatus may further contain a belt configured to provide under arm support to arms of the patient. The belt may include an adjustable buckle, a left under-arm pad positioned on a top of a left side of the belt, and a right under-arm pad positioned on a top of a right side of the belt. The belt may be mounted to the frame by at least four straps attached to the belt. A first strap of the at least four straps may be attached to a first top bar of the right side, a second strap and a third strap of the at least four straps may be attached to a second top bar of the back side, and a forth strap of the at least four straps may be attached to a third top bar of the left side. The right side of the frame may include a first adjustable middle bar and the left side of the frame may include a second adjustable middle bar. The first adjustable middle bar and the second adjustable middle bar may be configured to be gripped by hands of the patient. The back side of the frame may include an adjustable lower bar configured to support shins of the patient. The spinal disk apparatus may cause the patient supported by the spinal disk apparatus to experience a rehydrated spinal disk, a relieved sciatic nerve, back pain relief, or a combination thereof.

Figure 2:
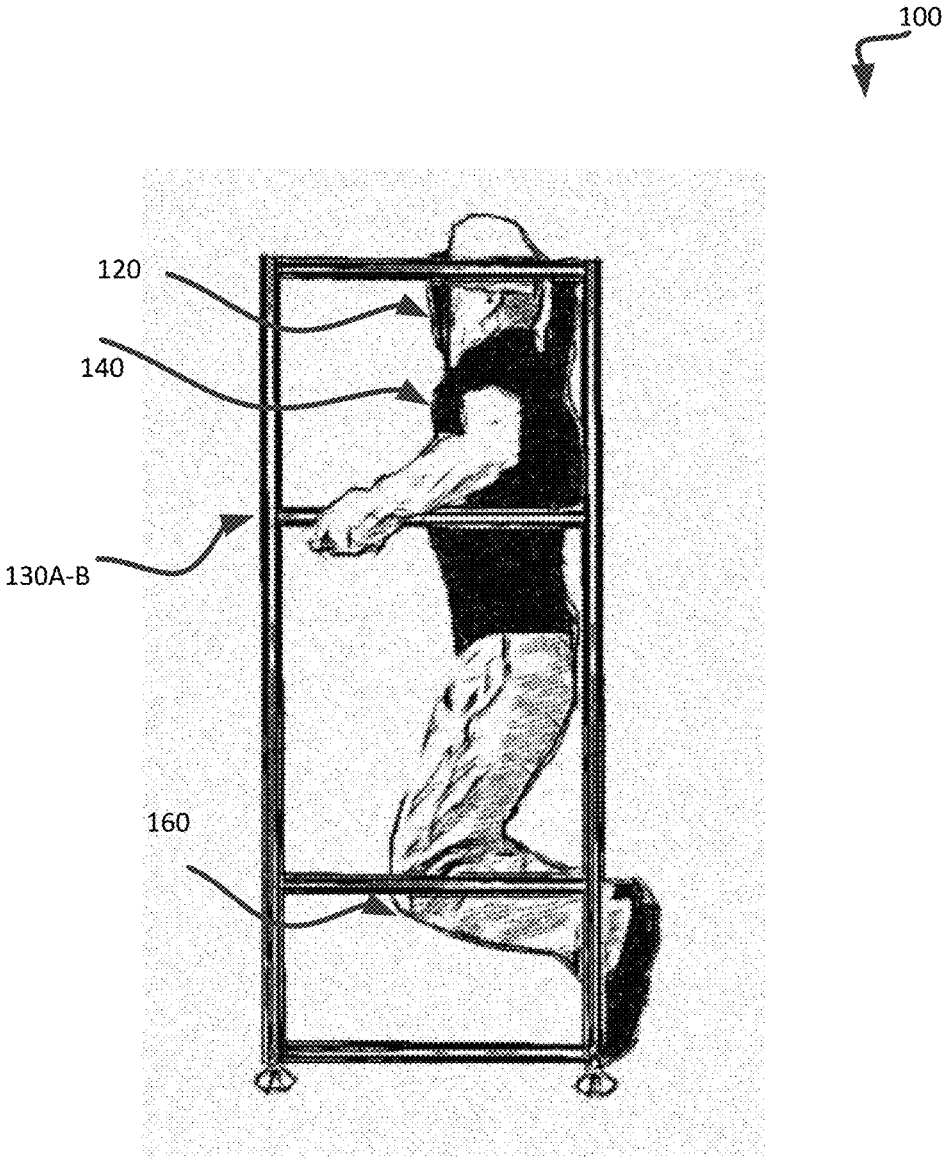
FIG. 2 illustrates a side view of an apparatus, in an unfolded state, for rehydrating spinal disks and relieving spinal disk pain of a patient, in accordance with embodiments of the disclosure.

FIG. 1 illustrates an apparatus 100 in an unfolded state for rehydrating spinal disks and relieving spinal disk pain of a patient, in accordance with embodiments of the disclosure. Spinal disk relief apparatus 100 may cause a patient supported by the spinal disk apparatus to experience back pain relief, a rehydrated spinal disk, a relieved sciatic nerve, or a combination thereof. FIG. 2 illustrates a side view of apparatus 100, in an unfolded state and in use by a patient, for rehydrating and relieving a spinal disk pain of a patient, in accordance with embodiments of the disclosure.

With reference to FIGS. 1-2, spinal disk relief apparatus 100 may include frame 110 configured to carry a body weight of a patient. Frame 110 may be made of a high-strength rigid material, e.g. aluminum, an aluminum alloy, carbon fiber, steel, Polyvinyl Chloride (PVC), and the like. In one embodiment, frame 110 is a metal frame. Frame 110 may have right side 115A, left side 115B, and back side 115C. Right side 115A and left side 115B may have approximately equal width, whereas the back side 115C may be of greater width than the left side and the right side. Right side 115A, left side 115B, and back side 115C of frame 110 may be made of cylindrical posts connected to each other at each end. The cylindrical posts may have equal diameters of approximately two inches wide. Alternatively, the posts may have a square or rectangular cross section.

Frame 110 may be in a folded state (e.g. in a compact, unusable state for shipping, storing, etc.) or in an unfolded state (e.g. usable state where a user may be able to use the apparatus for treatment). The first hinges 145A may connect right side 115A to a first end of back side 115C and second hinges 145B may connect left side 115B to a second end of back side 115C. The first and second hinges 145A-B may be adjusted to place the frame 110 in the folded or unfolded state. When frame 110 is in the folded state, right side 115A and left side 115B of frame 110 may be folded on back side 115C of frame 110. On the other hand, when frame 110 (and the spinal disk relief apparatus 100) is in the unfolded state, right side 115A may be at approximately a right angle to back side 115C and left side 115B may be at approximately a right angle to back side 115C.

Right side 115A of the frame may include adjustable middle bar 130A and left side 115B may include adjustable middle bar 130B. Adjustable middle bar 130A and adjustable middle bar 130B are configured to be gripped by the patient's hands for support while the patient is using the apparatus 100. Adjustable middle bars 130A-B may be adjustable in a vertical direction to accommodate the patient's height, torso length and/or arm length. For example, adjustable middle bars 130A-B may slide up and down to reach a position that is comfortable to the patient to place their hands on the bars. Back side 115C may include adjustable lower bar 160 configured to support shins of the patient using the apparatus 100, such that the patient's feet may not touch the ground while the patient uses the apparatus 100.

Back side 115C and/or the left and right sides 150A, 150B may further contain at least two locks 150A-B to keep frame 110 in the unfolded state. In one embodiment, lock 150A may be on the right side and lock 150B may be on the left side. In some implementations, back side 115C may further contain four locks to keep frame 110 in the unfolded state, one lock may be on the top right of back side 115C, a second lock may be on the bottom right of back side 115C, a third lock may be on the top left of back side 115C, and a forth lock may be on the bottom left of back side 115C. While frame 110 is in the unfolded state, locks 150A-B may be in a locked state and while frame 110 is in the folded state, locks 150A-B may be in an unlocked state.

Spinal disk relief apparatus 100 may further include belt 140 configured to provide under arm support to arms of the patient. Belt 140 may include an adjustable buckle, a left under-arm pad positioned on a top of a left side of the belt, and a right under-arm pad positioned on a top of a right side of belt 140. The adjustable buckle of belt 140 may be made adjustable via a group of holes within one end of belt 140 and the buckle is attachable to one hole of the group pf holes at a time. Alternatively, other known belt adjustment mechanisms may be used. In an initial state, the adjustable buckle may be unattached to a hole on the belt. The buckle may adjust the width of belt 140 to fit the patient's chest while the patient is using spinal relief apparatus 100. Belt 140 may be removable from the frame 110, e.g. for shipping or storing. Belt 140 may be made of a soft material (e.g. fabric) and the left under-arm pad and the right under-arm pad may be made of rubber foam or other foam and may be covered with fabric or another material. Belt 140 may have a length of approximately 4 feet.

Belt 140 may be mounted to frame 110 by at least four straps attached to belt 140. The straps may be made of a durable material (e.g. nylon) to carry at least some of the weight of the patient while using apparatus 100. The straps may be further adjustable to accommodate the patient's height, such that the patient shins may rest on lower back bar 160 and patient's hands may rest on middle side bars 130A-B. For example, a tall patient may use shortened straps and a short patient may use longer straps to reach the middle side bars 130A-B and the lower back bar 160 as needed. The straps may be positioned so that a first strap may loop around the top bar of right side 115A, a second strap and a third strap may loop around the top bar of back side 115C, and a fourth strap may loop around the top bar of left side 115B.

Spinal disk relief apparatus 100 may also include at least four feet 170A-D to balance and stabilize frame 110. First foot 170A may be connected to one bottom end of right side 115A, second foot 170B may be connected to the other bottom end of right side 115A, third foot 170C may be connected to one bottom end of left side 115B, and fourth foot 170D may be connected to the other bottom end of left side 115B of frame 110 in an embodiment. In order to provide stability, at least the bottom of each of the four feet may be made of a non-slip material (e.g. rubber, fabric, etc.).

In some embodiments, the patient may be require to follow a treatment procedure to get the most benefits of the apparatus. The treatment procedure may include steps to be performed by the patient before using the apparatus, during apparatus, after using the apparatus, or a combination thereof. In one implementation, a treatment procedure that may be performed by a patient may include a first step of drinking approximately 16 ounces of water before using the apparatus. A following step may be placing a heating pad on an area of the back of the patient for approximately 20 minutes. The area of the back of the patient may be where rehydration is desired or pain is experienced by the patient. After approximately 20 minutes, the patient may remove the heating pad and may start using the apparatus. The patient may start by wrapping belt 140 around his/her chest and adjusting straps 120 to accommodate the patient's height. At this point, the patient may be in a standing position. The patient then may start lowering his/her body by bending his/her knees gradually while being supported by belt 140 (may also be referred to herein as harness 140). The patient may further rest his/her hands on middle bars 130A-B and may rest his/her shins on lower bar 160 for support while most of the patient's weight is supported by the under-arm pads of belt 140. Relying on belt 140 for carrying the patient's weight may allow the force of gravity to relieve back pain by gradually separating adjacent vertebrae when the patient is suspended by the apparatus. The patient's session of using the apparatus in this way may initially have a duration of approximately 5 minutes, and may gradually increase the 5 minutes duration every week until a 30 minutes duration per session is reached. The patient may use the apparatus for three sessions per week in an embodiment.

After using the apparatus for the duration of the session, the patient may place his/her feet back on the floor and may unbuckle belt 140. The patient then may be seated and may apply an ice pack on the area of the back that is being treated. The application of the ice pack may continue for 20 minutes, as the final step of the treatment procedure.

Figure 3:
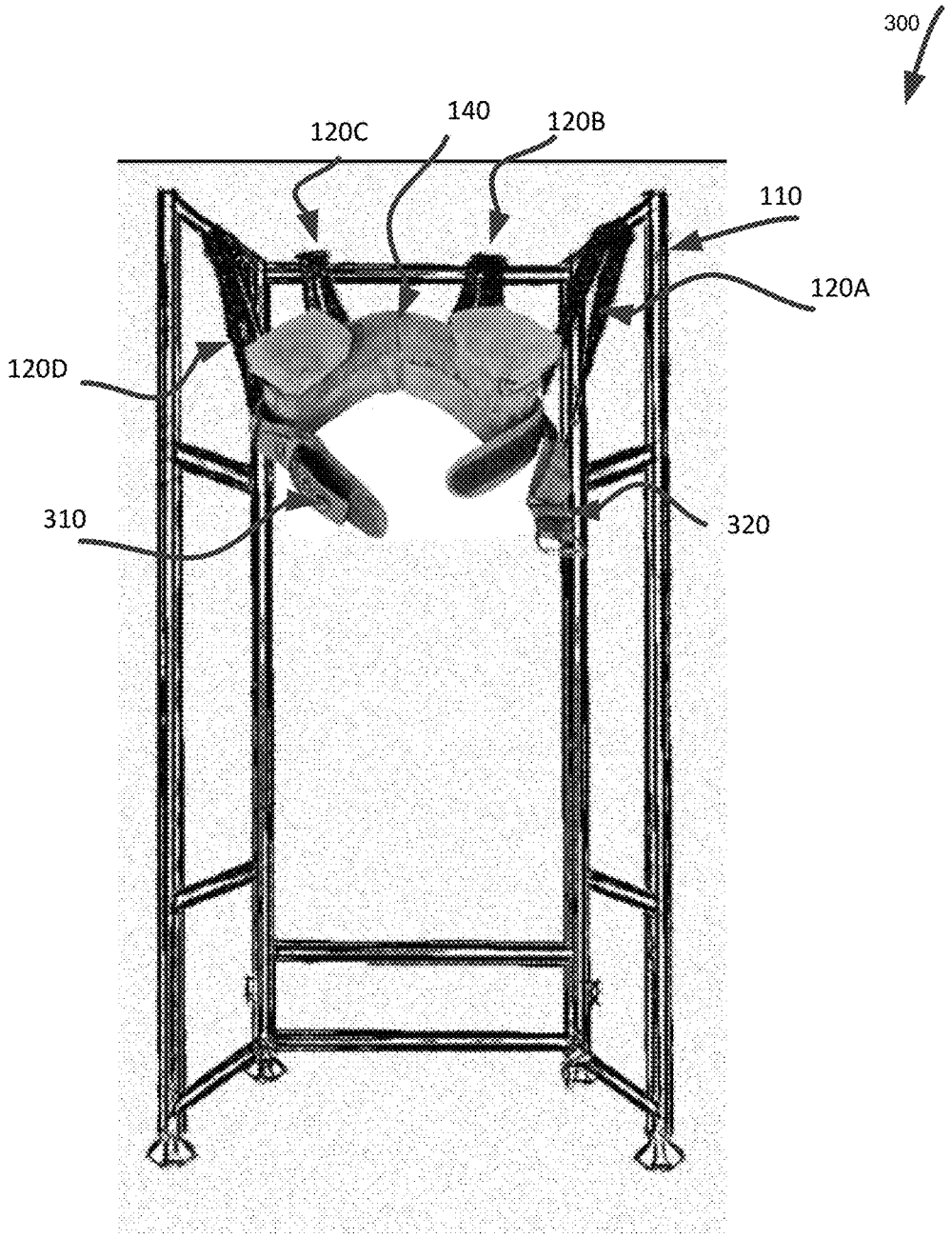
FIG. 3 illustrates another example of an apparatus, in an unfolded state, for rehydrating spinal disks and relieving spinal disk pain of a patient, in accordance with embodiments of the disclosure.

FIG. 3 illustrates another example of an apparatus 300, in an unfolded state, for rehydrating and relieving a spinal disk of a patient, in accordance with embodiments of the disclosure. Spinal relief apparatus 300 may refer to spinal relief apparatus 100 of FIG. 1. Spinal relief apparatus 300 may include frame 110 configured to carry a body weight of a patient. Spinal relief apparatus 300 may further include belt 140 configured to provide under arm support to arms of the patient. Belt 140 may include an adjustable buckle 320, a left under-arm pad positioned on a top of a left side of the belt, and a right under-arm pad positioned on a top of a right side of belt 140. The adjustable buckle of belt 140 may be made adjustable via a group of holes 310 within one end of belt 140. Buckle 320 may be attached to one hole of the group of holes at a time. In an initial state, adjustable buckle 320 may be unattached to a hole on the belt. Buckle 320 may adjust the width of belt 140 to fit the patient's chest while the patient is using spinal relief apparatus 300.

Referring to FIG. 3, belt 140 may be mounted to frame 110 by at least four straps 120A-D attached to belt 140. Straps 120A-D may be made of a durable material (e.g. nylon) to carry at least some of the weight of the patient while using apparatus 300. Straps 120A-D may be further adjusted to accommodate the patient's height. Each strap 120A-D may have a circumference of approximately 36 inches, and a width of approximately 2 inches. Strap 120A may be attached to the right side top bar of metal frame 110 at approximately 12 inches from one end of belt 140. Strap 120B may be attached to the back side top bar of metal frame 110 at approximately 12 inches from strap 120A. Strap 120C may be attached to the back side top bar at approximately 12 inches from strap 120B. Strap 120D may be attached to the left side top bar of metal frame 110 at approximately 12 inches from strap 120C. Although FIG. 3 illustrates belt 140 as having four straps 120A-D, embodiments of the disclosure may include a belt having more than four straps.

Figure 4:
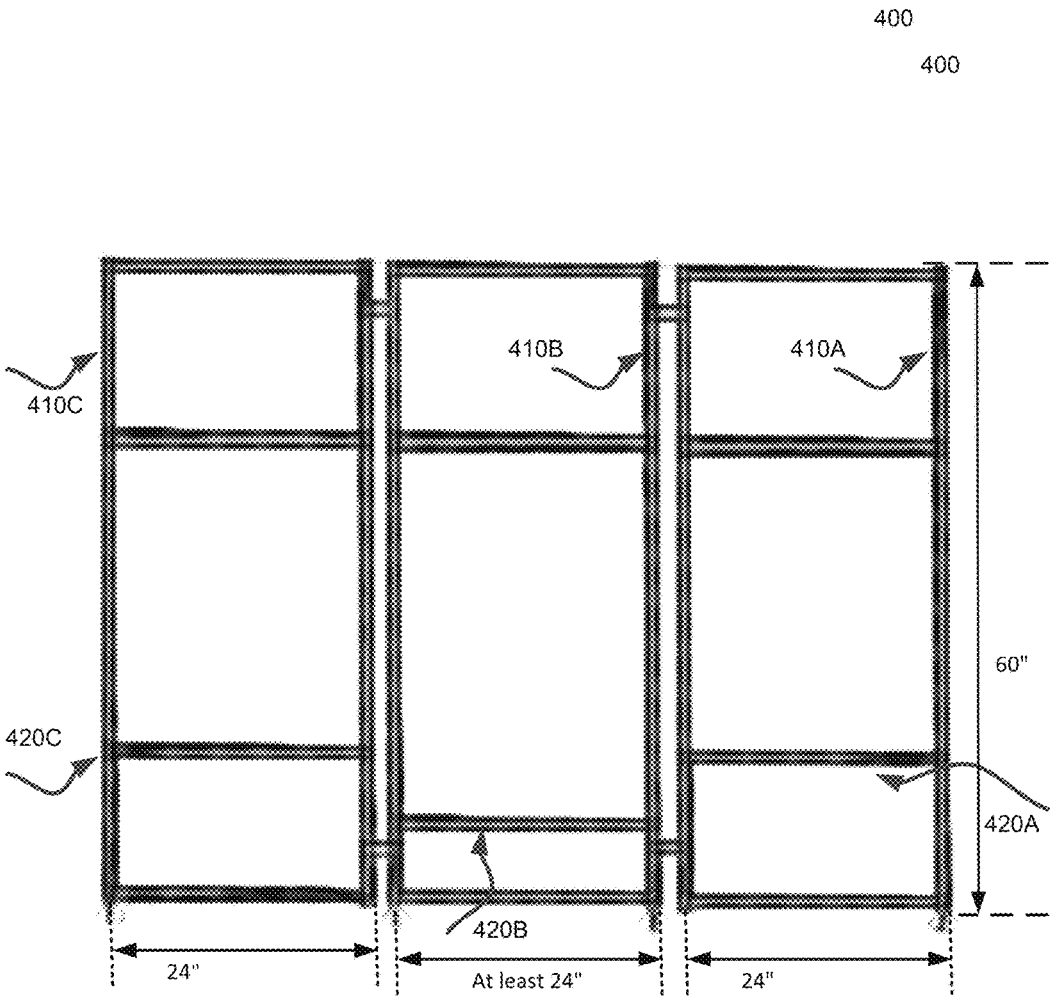
FIG. 4 illustrates a frame, in a flat state, of an apparatus for rehydrating spinal disks and relieving spinal disk pain of a patient, in accordance with embodiments of the disclosure.

FIG. 4 illustrates a frame 400, in a flat state, of an apparatus for rehydrating and relieving a spinal disk of a patient, in accordance with embodiments of the disclosure. Frame 400 may refer to frame 110 of spinal relief apparatus 100 of FIG. 1. Frame 400 may have a minimum height of approximately 60 inches and a maximum height of approximately 72 inches. Frame 400 may have right side 410A hinged to back side 410B via first hinges 430A, and back side 410B may be in turn hinged to left side 410C via second hinges 430B to a form three-sided frame 400. Right side 410A may have a minimum width of approximately 20 inches and a maximum width of approximately 36 inches. Back side 410B may have a minimum width of approximately 24 inches and a maximum width of approximately 40 inches. Left side 410C may have a minimum width of approximately 20 inches and a maximum width of approximately 36 inches.

Referring to FIG. 4, back side 410B may include adjustable lower bar 420B configured to support shins of a patient using metal frame 400, such that the patient's feet may not be touching the ground during use. By allowing the patient using the apparatus to be supported mostly by belt 140 with minimal to no weight on the patient's feet, the force of gravity may work to relieve back pain by gradually separating adjacent vertebrae while the patient is suspended by the apparatus. Lower bar 420B may be positioned vertically in back side 410B to support shins of the patient in a comfortable position, whereas lower bars 420A and 420C may be positioned vertically within right side 410A and left side 410C respectively to stabilize and support frame 400 in an unfolded position.

Figure 5:
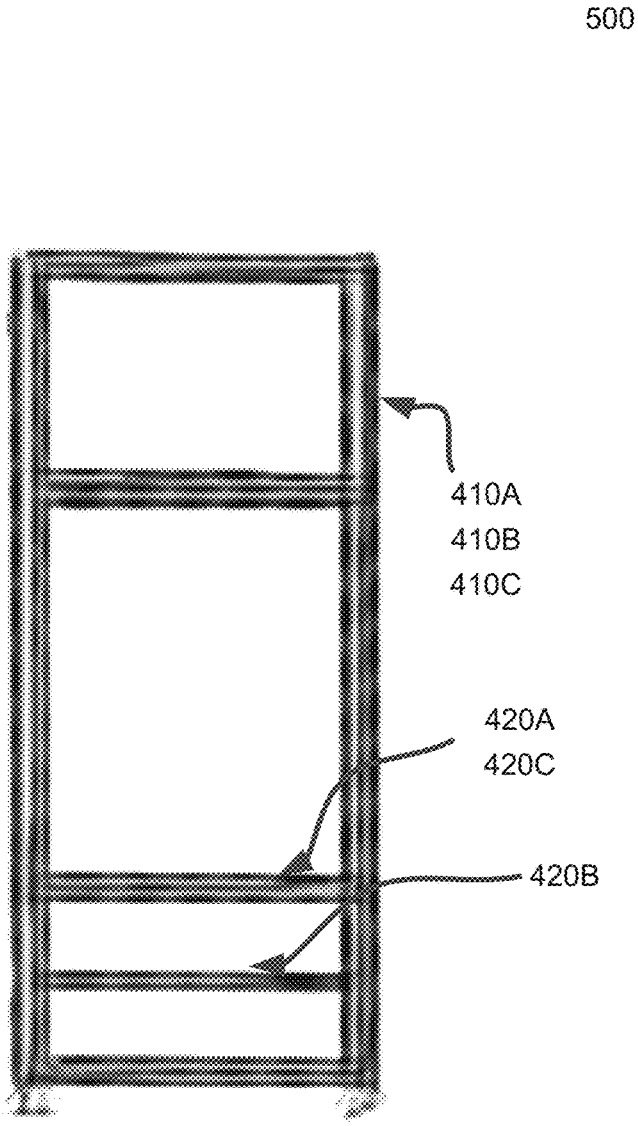
FIG. 5 illustrates a frame, in a folded state, of an apparatus for rehydrating spinal disks and relieving spinal disk pain of a patient, in accordance with embodiments of the disclosure.

FIG. 5 illustrates a frame 500, in a folded state, of an apparatus for rehydrating spinal disks and relieving spinal disk pain of a patient, in accordance with embodiments of the disclosure. Frame 500 may refer to frame 110 of spinal relief apparatus 100 of FIG. 1. As explained in more details herein above, frame 500 may be folded for purposes of shipping, storing, and the like. When frame 500 is in the folded state, right side 410A and left side 410C of frame 500 may be folded on back side 410B of frame 500 such that the frame may be in a compact state. Frame 500 may be folded when locks 150A-B of FIG. 1 (not shown) are in unlocked state. In embodiments, in order to bring frame 500 to a folded state, belt 140 of FIG. 1 may be detached from frame 500. Belt 140 (not shown) may then be stored separately.

Figure 6:
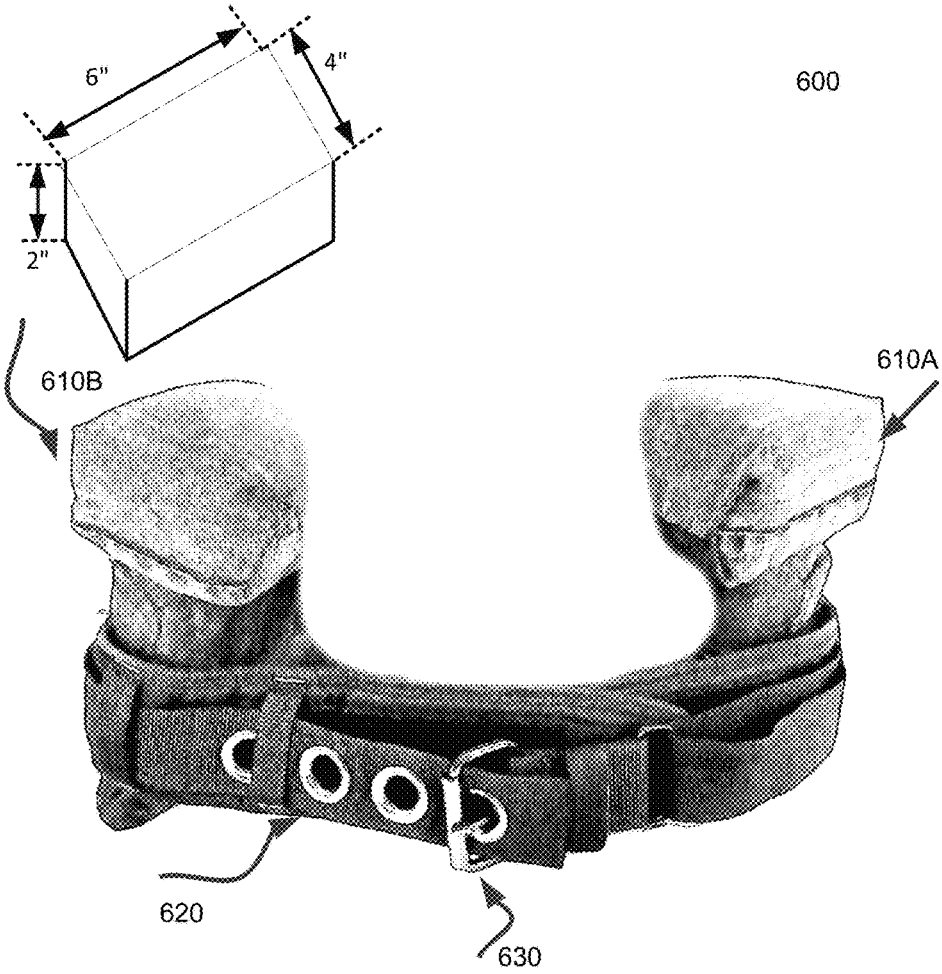
FIG. 6 illustrates a belt of an apparatus for rehydrating spinal disks and relieving spinal disk pain of a patient, in accordance with embodiments of the disclosure.

FIG. 6 illustrates belt 600 of an apparatus for rehydrating spinal disks and relieving a spinal disk of a patient, in accordance with embodiments of the disclosure. Belt 600 may refer to belt 140 of spinal relief apparatus 100 of FIG. 1. As explained in more details herein above, belt 600 may include a right under-arm pad 610A and a left under-arm pad 610B. Under-arm pads 610A-B may be made of rubber foam or another foam and may be covered with a soft material (e.g. fabric). In embodiments, under-arm pad 610 may have a height of approximately 6 inches, a width of approximately 4 inches, and a depth of approximately 2 inches. Referring to FIG. 6, as explained above, buckle 620 of belt 600 may be adjusted in width to fit the chest of a patient using the apparatus. Buckle 620 may be made adjustable via a group of holes 630 within one end of belt 600. Buckle 620 may be attached to one hole at a time (as shown).

Figure 7:
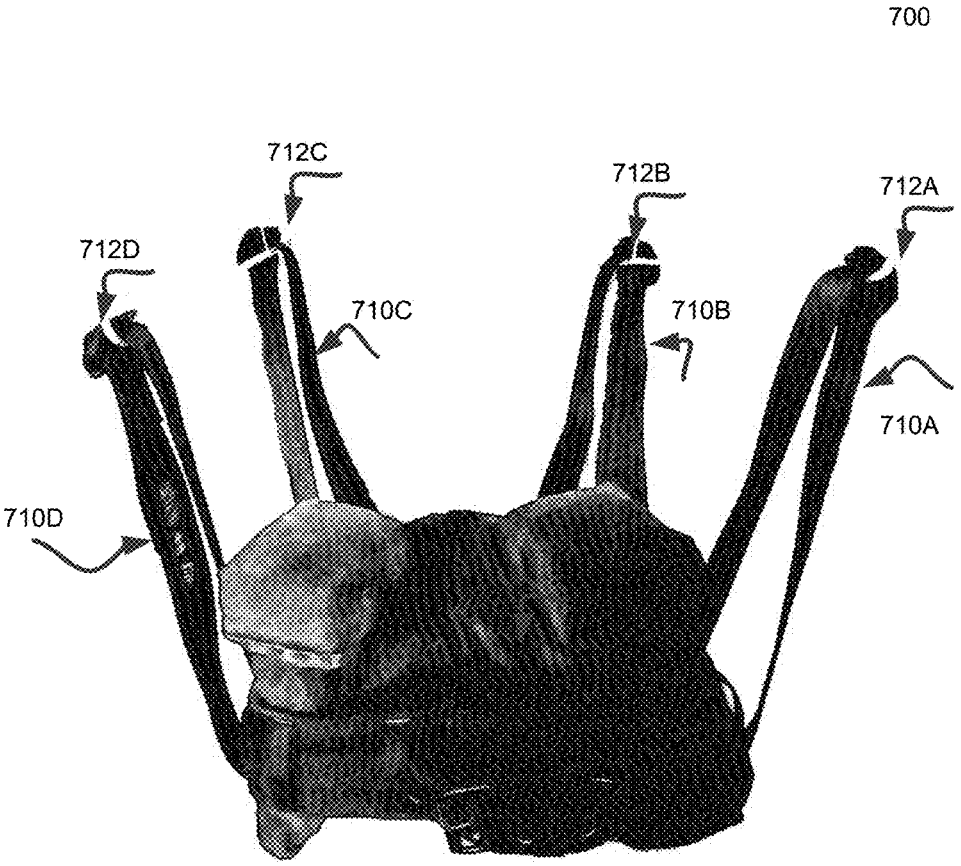
FIG. 7 illustrates a belt and straps of an apparatus for rehydrating spinal disks and relieving spinal disk pain of a patient, in accordance with embodiments of the disclosure.

FIG. 7 illustrates belt 700 and straps 710A-D of an apparatus for rehydrating and relieving pain in a spinal disk of a patient, in accordance with embodiments of the disclosure. Belt 700 may refer to belt 140 of spinal relief apparatus 100 of FIG. 1. As discussed previously, belt 700 may include straps 710A-D to attach the belt to the frame of the apparatus. Belt 700 may also be detached from the frame as shown for storing, shipping, cleaning, etc. Straps 710A-D may be adjusted to accommodate the patient's height. Each strap 710A-D may have a circumference of approximately 36 inches, and a width of approximately 2 inches. The length of each strap 710A-D may be adjusted via a corresponding buckle 712A-D of each strap. For example, strap 710A may be made shorter by looping a larger piece of strap 710A through buckle 712A, such that strap 710A may have an adjusted circumference of less than 36 inches. By having multiple straps connecting belt 700 to the frame stability and performance of the apparatus may be improved, accordingly a patient using the apparatus may be comfortably supported by belt 700.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or."

The above description is intended to be illustrative and not restrictive. For example, the above-described examples (or one or more aspects thereof) may be used in combination with each other. Other implementations can be used, such as by one of ordinary skill in the art upon reviewing the above description. The abstract is provided to comply with 37 CFR 1.72(b) to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed implementation. Thus, the following claims are hereby incorporated into the Detailed Description, with each claim standing on its own as a separate implementation, and it is contemplated that such implementations can be combined with each other in various combinations or permutations. The scope of the implementations of the disclosure should be determined with reference to the appended claims, along with the full scope of equivalents to which such claims are entitled.

In the drawings, which are not necessarily drawn to scale, like numerals may describe similar components in different views. Like numerals having different letter suffixes may represent different instances of similar components. The drawings illustrate generally, by way of example, but not by way of limitation, various implementations discussed in the present document.

What is claimed is:

1. A spinal disk relief apparatus, comprising:

a frame configured to carry a body weight of a patient, wherein the frame has a right side and a left side of approximately equal width and a back side of greater width than the left side and the right side, wherein the right side is connected to a first end of the back side by a first hinge, and the left side is connected to a second end of the back side by a second hinge, and wherein the right side is at approximately a right angle to the back side while the spinal disk relief apparatus is in an unfolded state, and wherein the left side is at approximately a right angle to the back side while the spinal disk relief apparatus is in the unfolded state;

a belt configured to provide under arm support to arms of the patient, the belt comprising an adjustable buckle, a left under-arm pad positioned on a top of a left side of the belt, and a right under-arm pad positioned on a top of a right side of the belt, wherein the belt is mounted to the frame by at least four straps attached to the belt, wherein a first strap of the at least four straps is attached to a first top bar of the right side, wherein a second strap and a third strap of the at least four straps are attached to a second top bar of the back side, and wherein a forth strap of the at least four straps is attached to a third top bar of the left side, wherein the right side of the frame comprises a first adjustable middle bar and the left side of the frame comprises a second adjustable middle bar, wherein the first adjustable middle bar and the second adjustable middle bar are configured to be gripped by hands of the patient; and wherein the back side comprises an adjustable lower bar configured to support shins of the patient; and wherein the spinal disk apparatus causes the patient supported by the spinal disk apparatus to experience at least one of a rehydrated spinal disk or a relieved sciatic nerve.

2. The apparatus of claim 1, wherein the frame is made of aluminum or an aluminum alloy.

3. The apparatus of claim 1, wherein the right side, the left side, and the back side of frame comprise cylindrical posts.

4. The apparatus of claim 3, wherein the cylindrical posts have equal diameters of approximately two inches wide.

5. The apparatus of claim 1 further comprising at least four feet, wherein a first foot of the at least four feet is attached to a first bottom end of the right side, wherein a second foot of the at least four feet is attached to a second bottom end of the right side, wherein a third foot of the at least four feet is attached to a third bottom end of the left side, and wherein a fourth foot of the at least four feet is attached to a forth bottom end of the left side of the frame.

6. The apparatus of claim 5 further comprising a non-slip material on at least a bottom of each of the at least four feet.

7. The apparatus of claim 1, wherein the at least four straps comprise nylon.

8. The apparatus of claim 1, wherein the at least four straps of the belt are adjustable to accommodate a height of the patient.

9. The apparatus of claim 1, wherein the left under-arm pad and the right under-arm pad comprise rubber foam.

10. The apparatus of claim 1, wherein the belt has a length of approximately four feet.

11. The apparatus of claim 1, wherein the first adjustable middle bar of the right side of the frame and the second adjustable middle bar of the left side of the frame are adjustable in a vertical direction.

12. The apparatus of claim 1, wherein the back side of the frame further comprises at least two locks to keep the frame in the unfolded state, the at least two locks comprising a first lock on the right side and a second lock on the left side.

13. The apparatus of claim 12, wherein the frame in the unfolded state comprises the at least two locks in a locked state.

14. The apparatus of claim 12, wherein the frame in a folded state comprises the at least two locks in an unlocked state.

15. The apparatus of claim 1, wherein the adjustable buckle of the belt is adjustable to fit a chest of the patient.

16. The apparatus of claim 1, wherein the belt comprises a plurality of holes, and wherein the adjustable buckle is attachable to one hole of the plurality of holes at a time to adjust the width of the belt.

17. The apparatus of claim 16, wherein the adjustable buckle of the belt in an initial state is unattached to a hole in the plurality of holes.

18. The apparatus of claim 1, wherein the first strap of the at least four straps is located at approximately 12 inches from a first end of the belt, wherein the second strap of the at least four straps is located approximately 12 inches from the first strap, wherein the third strap of the at least four straps is located approximately 12 inches from the second strap, and wherein the forth strap of the at least four straps is located approximately 12 inches from the third strap.

19. The apparatus of claim 1, wherein in a folded state, the right side and the left side of the frame are folded on the back side of the frame.

20. The apparatus of claim 1, wherein the belt is removable from the frame.

* * * * *